United States Patent [19]

Kirsch

[11] Patent Number: 4,581,831

[45] Date of Patent: Apr. 15, 1986

[54] SKI-BOOT

[76] Inventor: Bernhard Kirsch, Im Litzelholz 23, D-5500 Trier, Fed. Rep. of Germany

[21] Appl. No.: 629,548

[22] PCT Filed: Dec. 6, 1983

[86] PCT No.: PCT/DE83/00199

§ 371 Date: Jul. 2, 1984

§ 102(e) Date: Jul. 2, 1984

[87] PCT Pub. No.: WO84/02258

PCT Pub. Date: Jun. 21, 1984

[30] Foreign Application Priority Data

Dec. 15, 1982 [DE] Fed. Rep. of Germany ..... 3246435

[51] Int. Cl.[4] ..... A43B 5/04

[52] U.S. Cl. ..... 36/119; 36/54

[58] Field of Search ..... 36/117–121, 36/54

[56] References Cited

U.S. PATENT DOCUMENTS 3,883,964 5/1975 Check ..... 36/119
4,193,215 3/1980 Hensler ..... 36/117 X
4,196,530 4/1980 Delery ..... 36/119
4,406,073 9/1983 Spademan ..... 36/119

FOREIGN PATENT DOCUMENTS 433055 9/1967 Switzerland ..... 36/119

*Primary Examiner*—James Kee Chi
*Attorney, Agent, or Firm*—Ward Brown; Robert W. Beach

[57] ABSTRACT

A ski-boot has a lower part, receiving the foot, with an instep plate engaging over the instep of the foot, and a boot leg which, for walking, is swingable on the lower part of the boot about an axis of rotation, extending transversely to the longitudinal direction of the lower part of the boot and arranged in the heel region, between a vorlage position and an approximately upright position. In order to lock the leg of the boot in the vorlage position, a locking device with a manually actuable stop lever is proposed which in the locking position, by way of a thrust bolt, wedge, eccentric or the like extending substantially perpendicularly to the instep plate, loads the instep plate and secures the leg of the boot in the vorlage position and which in the release position releases both the instep plate and the leg of the boot.

17 Claims, 21 Drawing Figures

SKI-BOOT

BACKGROUND OF THE INVENTION

1. Field of the Invention

The present invention relates to a ski boot of the type having a lower or foot part that receives the foot with a plate engaged over the instep and an upper or leg part receiving the lower leg and mounted on the lower part for swinging about an axis extending transversely to the longitudinal direction of the boot in the area of the heel. The boot upper part is swingable between an upright position and a vorlage position and locking mechanism is provided to retain the upper part in the vorlage position during skiing.

2. Prior Art

In a known ski boot the locking of an upper or leg part of the boot into the vorlage position occurs automatically when such upper part is swung forward. When walking with such known ski boot, such locking often occurs unintentionally which requires that the locking mechanism be released manually before normal walking can be resumed.

In another known ski boot an ankle sleeve is hinged to the rear of a boot lower part and, for easy insertion of the foot and for walking, is swingable rearward about the pivot of the hinge. A disadvantage of this boot is that rearward tilting of the ankle sleeve during walking separates the sleeve and the lower part which can expose the foot to cold air or snow.

SUMMARY OF THE INVENTION

The present invention provides a ski boot having a lower, foot-enclosing part with an instep plate and a swingable upper, leg-enclosing part that can be locked to the lower part in a vorlage position, but which can be released for comfortable walking without exposing the foot to cold air or snow.

In a preferred embodiment, the locking mechanism includes a lever pivotally mounted on the lower boot part and cooperating with a latch engageable with a catch carried by the upper boot part for locking the upper boot part in the vorlage position. The lever also cooperates with mechanism connected to the instep plate for pressing the instep plate inward when the upper part is locked in the vorlage position, but such mechanism releases the instep plate when the boot upper part is free to swing for walking. The lever can be biased to its released position to prevent unintentional locking of the boot upper part in the vorlage position.

Preferably, the upper portion of the boot lower part is telescoped inside the lower portion of the boot upper part. The overlapping portions of such parts are in close sliding engagement so that the foot is not exposed to cold air or snow regardless of whether the boot upper part is in its released walking position or its forward swung vorlage position. The overlapping portions of the two parts at the front and back of the boot can have arcuate segments equidistant from the axis of the pivot connecting the two parts. Such axis is preferably disposed in the area of the heel, a substantial distance above the boot sole and rearward of the axis of the ankle joint.

Preferably, the inward pressure applied against the instep plate when the upper part is locked in its vorlage position is adjustable.

DETAILED DESCRIPTION

Figure 1:
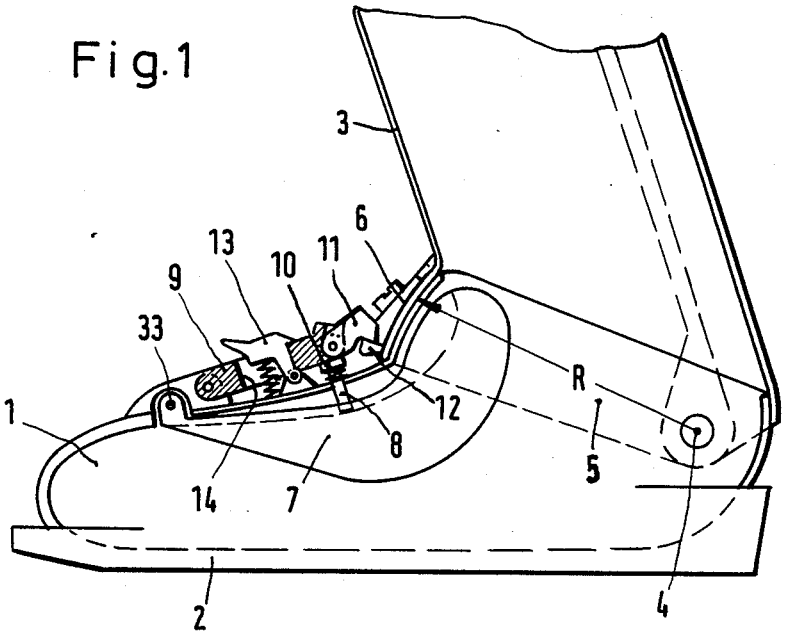
FIG. 1 is a somewhat diagrammatic side elevation of a ski boot in accordance with the present invention having an upper part pivoted on a lower part and mechanism for locking the upper part in a vorlage position, with parts shown in section and parts broken away.

As shown in FIG. 1, a ski boot in accordance with the present invention has a lower part 1 receiving the foot. Such lower or foot part has a flat sole 2 for resting on the surface of a ski. An upper portion 3 of the boot encircles the lower leg and is mounted on the lower part for swinging about a horizontal axis 4 extending transversely of the boot. Such axis is located in the area of the heel, above the boot sole and behind the axis of the ankle joint of the wearer.

Figure 2:
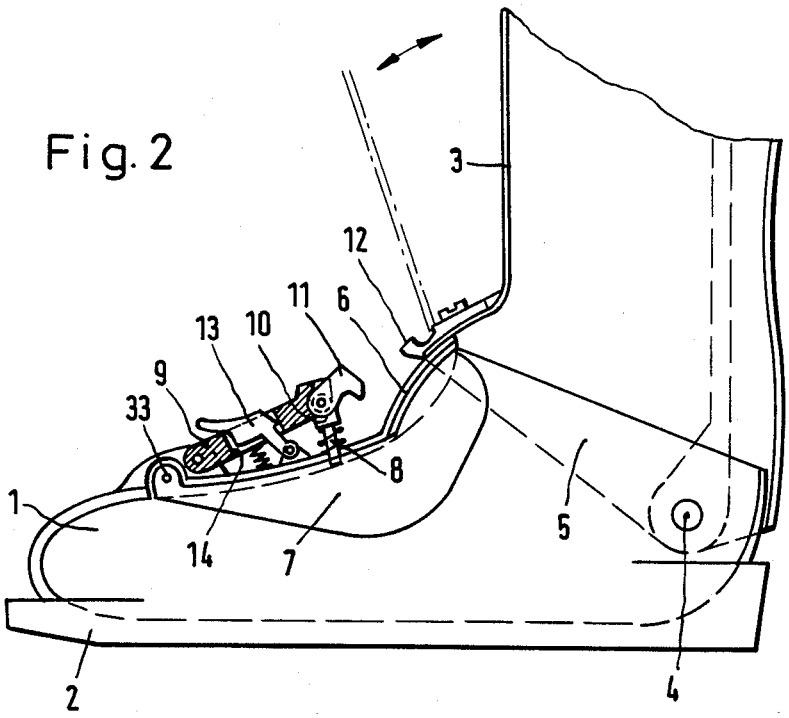
FIG. 2 is a corresponding side elevation of the ski boot shown in FIG. 1 with parts in different positions.

FIG. 1 illustrates the forward swung or vorlage position of the upper boot part 3 appropriate. for skiing. As illustrated in FIG. 2, for walking the upper boot part 3 swings about its axis 4 between the vorlage position and a more upright position.

The bottom end portion of the boot upper or leg part 3 closely encircles the upper end portion of the boot lower or foot part 1. To prevent air or snow from penetrating into the boot, the overlapping surfaces of the two boot parts are in close sliding contact in all swung positions of the upper part 3. At the front of the boot, in the area of the instep, such overlapping portions are arcuate. More specifically, for any longitudinal vertical section preferably the arc of contact between the overlapping instep portions is equidistant from the pivot axis 4, as represented by the radius R shown in FIG. 1.

The leading end portion of an arcuate instep plate 7 is pivoted to the boot lower part 1 for swinging about a horizontal transverse axis 33 for substantially up and down movement of such instep plate. An upright bolt 8 extends through the boot lower part, rearward of the axis 33, into engagement with the instep plate. Such bolt is biased upward to the position shown in FIG. 2 by a helical compression spring encircling the bolt shank and having its opposite end portions engaged against the upper surface of the boot lower part 1 and the enlarged upper head of the bolt.

Figure 11:
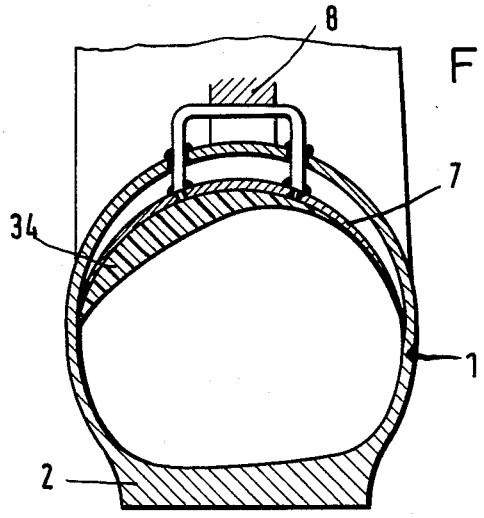
FIG. 11 is a transverse vertical section through a ski boot in accordance with the present invention, with parts broken away, illustrating a bifurcated thrust bolt.
Figure 12:
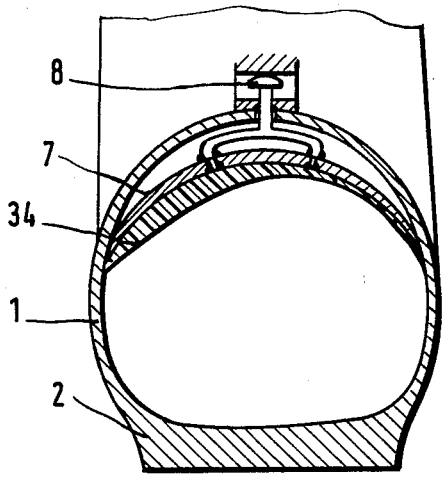
FIG. 12 is a transverse vertical section through a ski boot in accordance with the present invention, with parts broken away, illustrating a modified bifurcated thrust bolt.

Preferably, the bottom end portion of the bolt is bifurcated as represented in FIGS. 11 and 12, which show alternative embodiments, and the bottom ends of the bolt bifurcations are secured to the instep plate at opposite sides of the center line of the boot. In the form shown in FIG. 11 both bifurcations of the bolt extend downward through the top of the boot lower part 1, whereas in the embodiment shown in FIG. 12 the bolt bifurcations are disposed inside the boot with only the central bolt shank extending through the top of the boot lower part. As also seen in FIGS. 11 and 12, padding 34 can be carried on the underside of the instep plate 7 to adapt the interior of the boot to the shape of a user's foot.

Returning to FIGS. 1 and 2, a rearward projecting locking lever 9 has its leading end portion pivotally connected to the top of the boot lower part 1. The bottom surface 10 of the rear end portion of such lever is engaged against the top of the bolt 8. A latch member 11 projects rearward from the lever 9 and, as seen in FIG. 1, has a downward projecting hook engageable in an upward opening recess of a catch member 12 carried at the front of the bottom end portion of the boot upper part 3, when such upper part is in its forward swung or vorlage position, to lock such upper part in such position.

The locking lever 9 has a through slot 14 for the bottom end portion of a retaining lever 13 pivoted to the top of the bottom boot part 1 below the lever 9. Such retaining lever 13 has a rearward-projecting hook that engages over the top margin of the slot 14 to retain the lever 9 in its downward swung position when the upper part of the boot is locked in the vorlage position as shown in FIG. 1. In such position, the bolt 8 is pressed downward to swing the instep plate against the top of the wearer's foot for firmly holding the foot during skiing. A helical compression spring biases the retaining lever 13 to the position shown in FIG. 1 to prevent accidental releasing of the lever 9 and, consequently, the upper boot part 3 during skiing. For walking, the lever 13 can be manually swung forward, whereupon the force of the compression spring encircling the bolt 8 swings the lever 9 upward to the position shown in FIG. 2 and releases the hook of the latch 11 from the recess of the catch 12 to allow swinging movement of the upper boot part 3 for comfortable walking. In addition, the instep plate 7 is released so that undue pressure is not applied in the area of the instep during walking. Further, since the locking lever 9 is biased to its upward swung position shown in FIG. 2, the boot upper part will not be unintentionally locked in the vorlage position.

To intentionally lock the boot upper part in its vorlage position, the upper part is swung forward and the rear end portion of the locking lever 9 is pushed down. The compression spring engaged against the retaining lever 13 automatically swings the lever rearward to engage its hook over the top of the locking lever 9.

Figure 13:
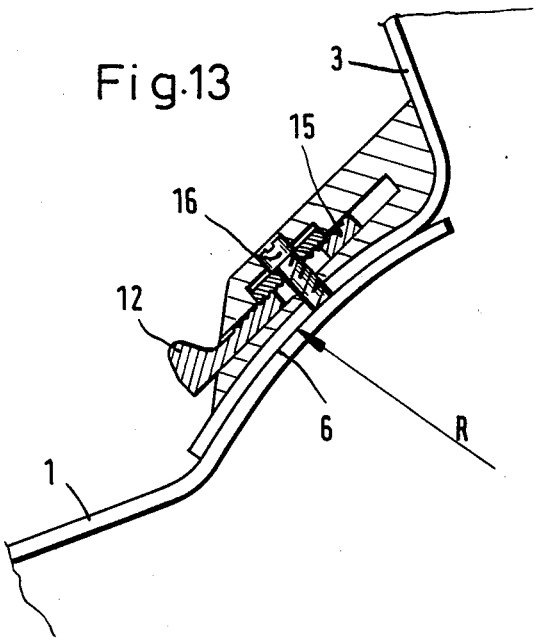
FIG. 13 is an enlarged, fragmentary, side elevation of a ski boot in accordance with the present invention, with parts shown in section, illustrating a modified catch on the upper boot part.

Preferably, the forward inclined angle of the boot upper part 3 when locked in the vorlage position can be adjusted, which can be achieved by adjusting the position of the catch 12 carried by the boot upper part. In the embodiment shown in FIG. 13, the catch 12 is slidable fore and aft in a slot of a mounting block secured to the front of the boot upper part 3 and has a top serrated or ribbed surface. A pressure plate 15 having a correspondingly serrated or ribbed bottom surface normally is held against the upper surface of the catch by a screw 16 which can be loosened to permit the position of the catch 12 to be adjusted.

Figure 14:
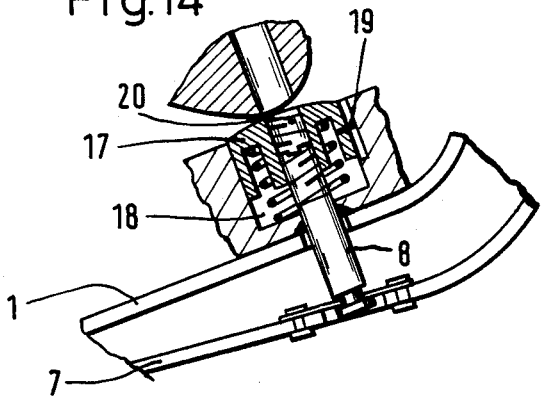
FIG. 14 is an enlarged, fragmentary, side elevation of another ski boot in accordance with the present invention, with parts shown in section, illustrating another modified thrust bolt.

Similarly, preferably the effective length of the bolt 8 can be adjusted to adjust the inward swung position of the instep plate 7 when the boot upper part is locked in the vorlage position. In the embodiment shown in FIG. 14, the head 17 of the bolt 8 is in the form of a nut screwed onto the threaded upper end portion of the bolt shank. Such nut is slidable up and down in a recess of a mounting block secured to the top of the boot lower part 1, but by reason of a pin 19 fitted in a slot in the rear end portion of the recess is nonrotatable relative to the mounting block. Nevertheless, the upper end of the bolt shank has a slot or socket exposed through the central recess of the nut 17, allowing a tool to be inserted to rotate the bolt shank to adjust its effective length and, consequently, adjust the position of the instep plate 7 when the upper part of the boot is locked in the vorlage position.

Figure 15:
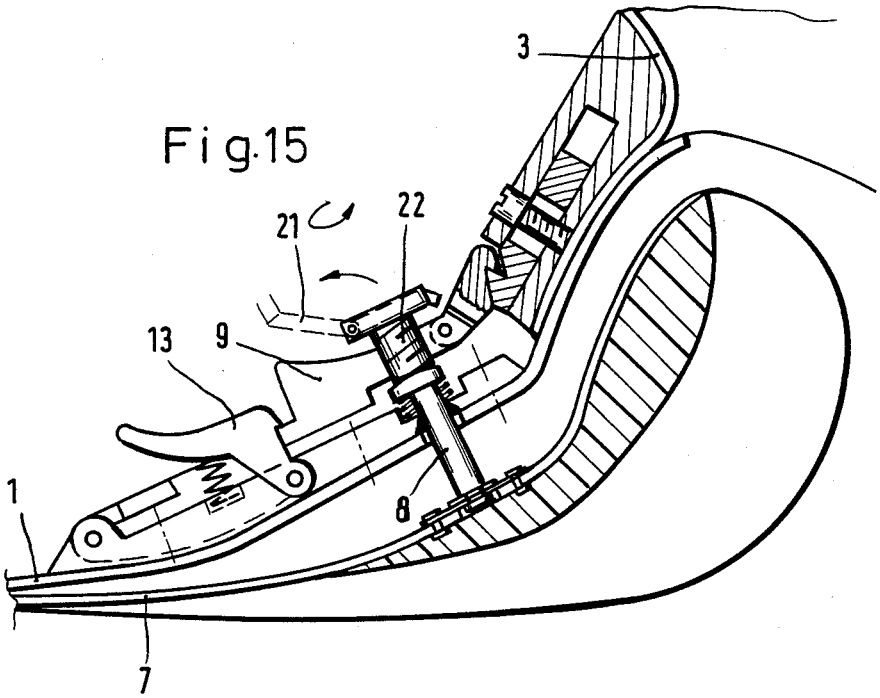
FIG. 15 is an enlarged, fragmentary, side elevation of another ski boot in accordance with the present invention, with parts shown in section, illustrating another modified form of locking mechanism.

Alternatively, as shown in FIG. 15, the enlarged head of the bolt 8 can be engaged by the bottom end of an adjustment thumb screw 22 having a handle 21 and threaded through the locking lever 9. Turning the thumb screw adjusts the extent to which the instep plate 7 is pressed inward when the locking lever 9 is moved down to lock the upper boot part 3 in its vorlage position. An advantage of the construction shown in FIG. 15 is that the position of the instep plate 7 can be adjusted even when the upper boot part 3 is locked in the vorlage position.

Figure 16:
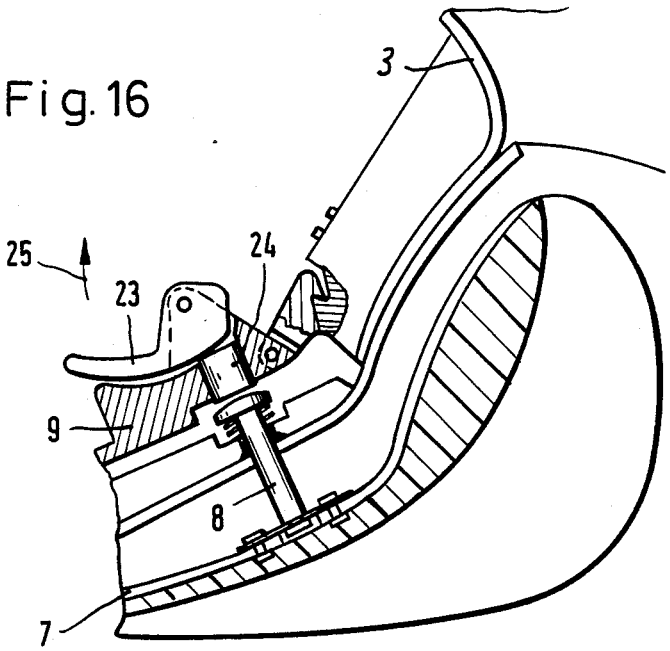
FIG. 16 is an enlarged, fragmentary, side elevation of another ski boot in accordance with the present invention, with parts shown in section, illustrating another modified form of locking mechanism.

Similarly, in the construction shown in FIG. 16, the head of the bolt 8 normally is engaged against the bottom of a pin 24 slidable in a hole through the locking lever 9. The upper end of such pin is held against an eccentric cam member 23 swingably mounted on the locking lever. The cam member 23 has adjacent surfaces spaced different distances from the pivot axis of the eccentric cam for positioning the pin 24 and, consequently, the bolt 8 and instep pressure plate 7 at different positions. For example, swinging the eccentric cam member in the direction of the arrow 25 in FIG. 16 would allow upward movement of the pin 24 to the next cam surface closer to the pivot axis of the cam member which, in turn, would allow the pin 24 to slide upward, and, by upward movement of the bolt 8, relieve the pressure applied at the instep by the instep plate 7.

Figure 3:
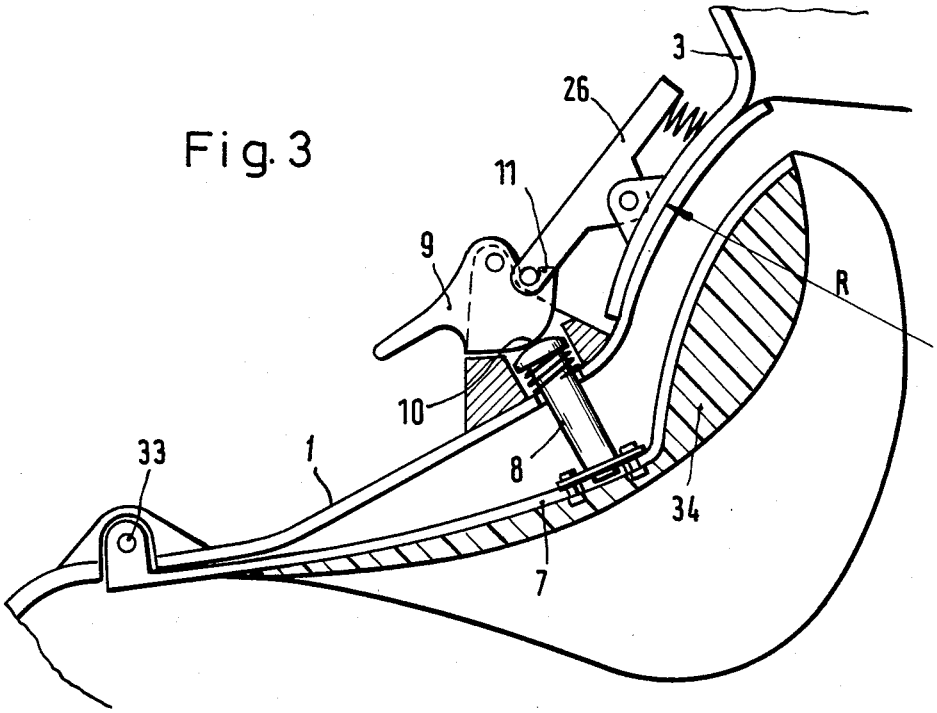
FIG. 3 is an enlarged, fragmentary, side elevation of another ski boot in accordance with the present invention with parts shown in section, illustrating a modified form of locking mechanism.

In the embodiment shown in FIG. 3, the locking lever 9 itself is in the form of an eccentric cam pivotally mounted on the bottom boot part 1 for rotation about an axis substantially directly above above the bolt 8. Rotation of such locking lever in a clockwise direction as viewed in FIG. 3 reduces the extent to which the bolt 8 and instep plate 7 are pressed inward into the ski boot, whereas counter clockwise movement of the locking lever 9 increases the extent to which the bolt 8 and instep plate 7 are pressed inward against the foot.

Another modification of the embodiment shown in FIG. 3 is that the catch member mounted on the upper boot part 3 is in the form of a lever 26 extending generally up and down from a central pivot. Lever 26 has a pin carried at its lower end portion adjacent to the upper surface of the locking and stop lever 9. Such locking and stop lever has a projection 11 forming an upward opening groove for receiving the pin of the catch lever 26 for locking the boot in the vorlage position. A helical compression spring biases the catch lever downward. The upper boot part can be released from the vorlage position by rotation of the stop lever 9 in a clockwise direction as viewed in FIG. 3 which also allows the bolt 8 and instep plate 7 to swing upward for comfortable walking.

Figure 4:
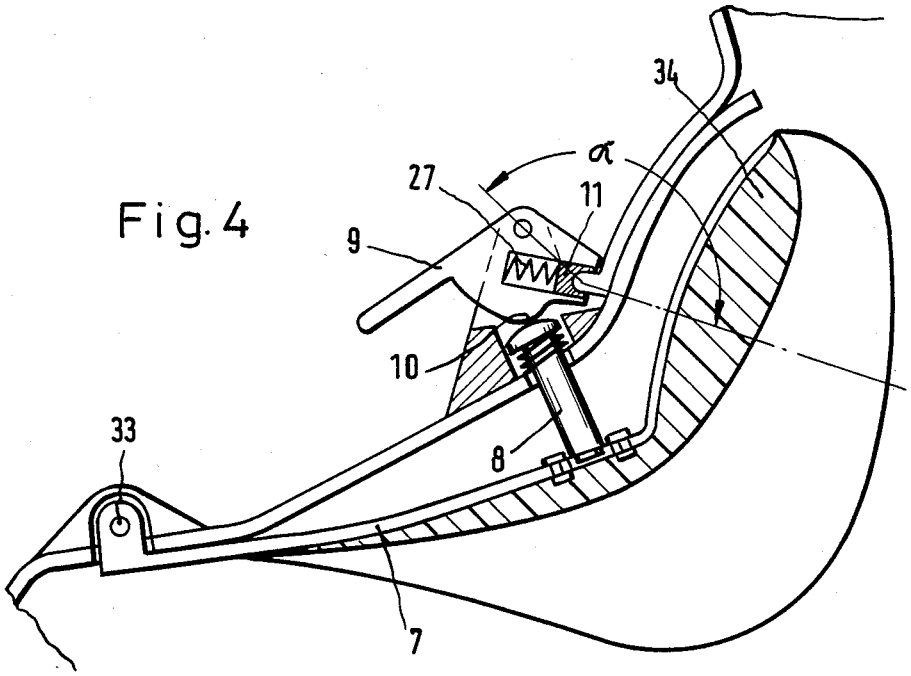
FIG. 4 is an enlarged, fragmentary, side elevation of another ski boot in accordance with the present invention, with parts shown in section, illustrating another modified form of locking mechanism.

In the embodiment in FIG. 4, as in the embodiment shown in FIG. 3, the locking and stop lever 9 is in the form of an eccentric cam pivotable about an axis substantially directly above the bolt 8 connected to the instep plate 7. The bottom pressure surface 10 of the cam is engaged against the head of the bolt 8 connected to the instep plate 7 for holding it in its inward projected position shown in FIG. 4. The latch member 11 of the locking lever 9 is carried in a slot in the upper end portion of the locking lever and is biased outward by a compression spring 27. Such latch member 11 has an outer groove for receiving a projection of the upper boot part for locking such part in the vorlage position. Swinging movement of the locking member 9 in a counterclockwise direction as shown in FIG. 4 releaes the upper boot part projection from the latch member 11 and also allows the bolt 8 to be moved outward by the force of its compression spring.

In both the embodiment shown in FIG. 3 and the embodiment shown in FIG. 4, the pressure surface 10 of the cam member is designed so that force exerted against it by the head of the bolt 8 positively retains the eccentric cam locking lever 9 in its locking position or in its released position.

Figure 5:
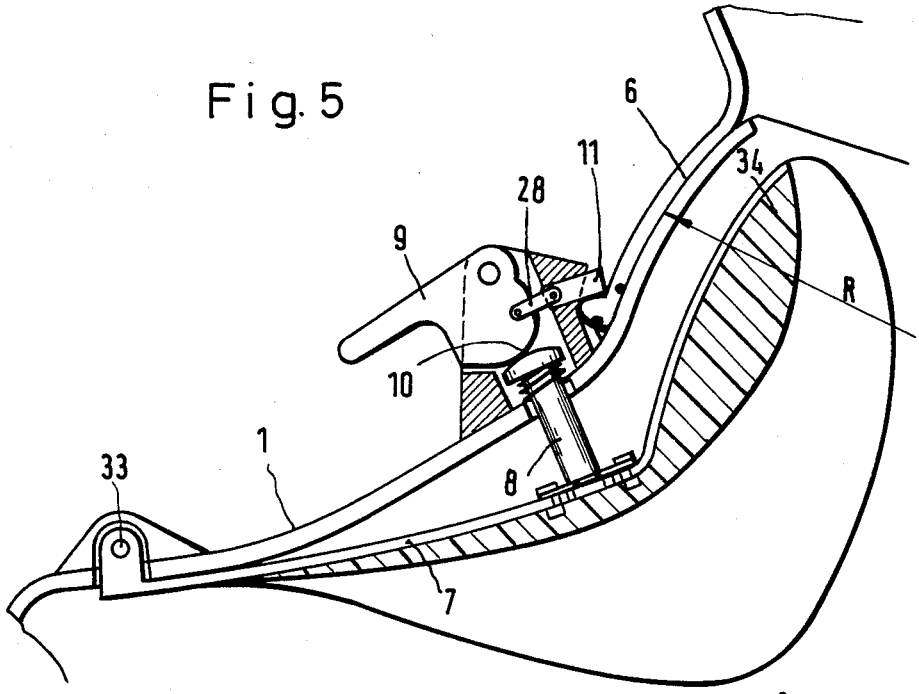
FIG. 5 is an enlarged, fragmentary, side elevation of another ski boot in accordance with the present invention, with parts shown in section, illustrating another modified form of locking mechanism.
Figure 6:
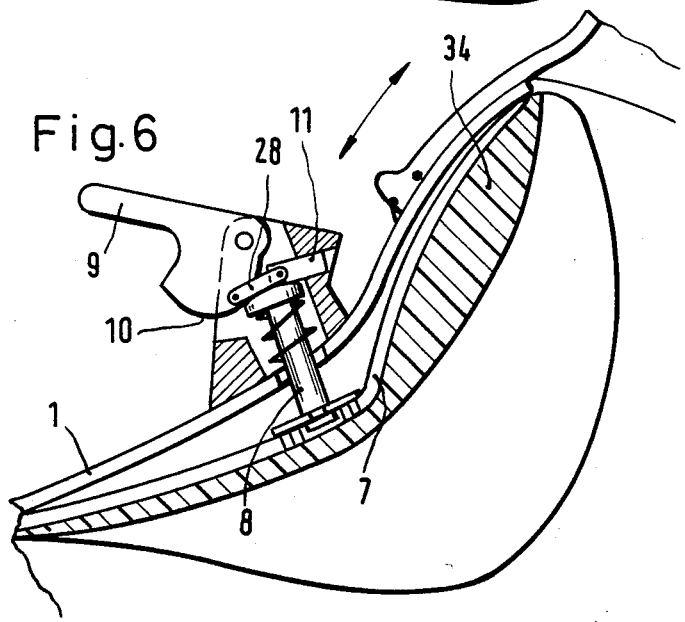
FIG. 6 is a corresponding fragmentary side elevation of the boot of FIG. 5 with parts in different positions.

In the embodiment shown in FIGS. 5 and 6, again the locking lever 9 is in the form of an eccentric cam swingable about an axis substantially directly above the bolt 8 connected to the instep plate 7. Such lever has the bottom pressure surface 10 engaged against the head of the bolt to retain the instep plate in its inward moved position as shown in FIG. 5 or allowing outward movement of the bolt and instep plate to the position shown in FIG. 6. Latch member 11 projects rearward from the locking lever 9 and is slidable through a substantially horizontal slot through the mounting block carrying the locking lever. The rear end of the latch member 11 is connected to the rear portion of the locking lever by a generally horizontal link 28 pivotally connected between the locking lever and the latch member. Consequently, swinging the locking lever from the position shown in FIG. 6 to the position shown in FIG. 5 projects the latch member 11 rearward to engage over a projection of the upper boot part to lock the upper boot part in the vorlage position; whereas swinging the locking lever 9 from the position shown in FIG. 6 to the position shown in FIG. 5 retracts the latch member 11 into its slot to release the upper boot part and also allows outward movement of the bolt 8 and the instep plate 7.

Figure 7:
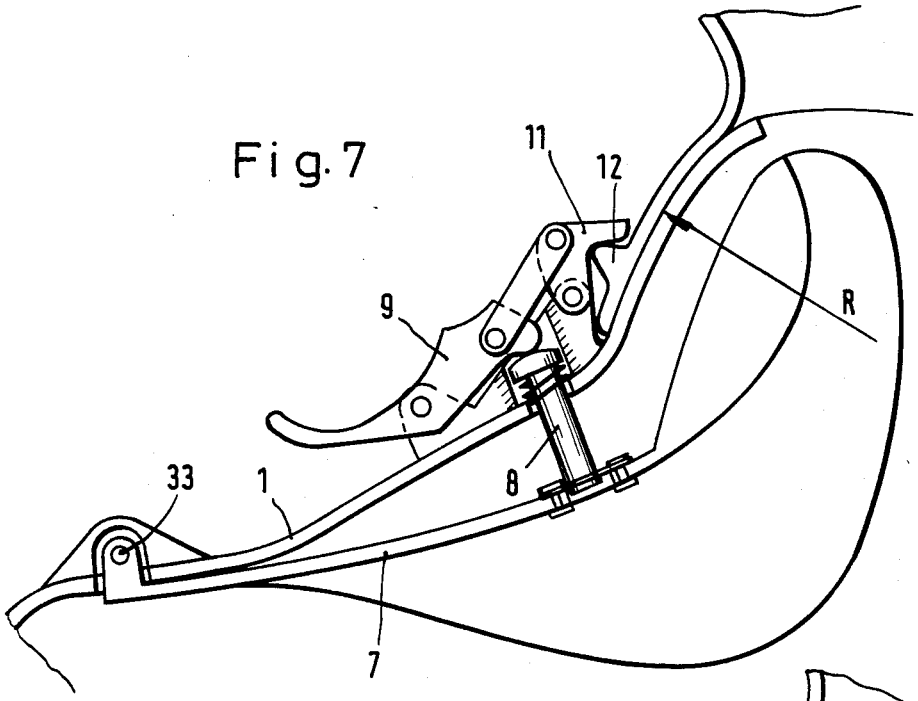
FIG. 7 is an enlarged, fragmentary, side elevation of another ski boot in accordance with the present invention with parts shown in section, illustrating another modified form of locking mechanism.
Figure 8:
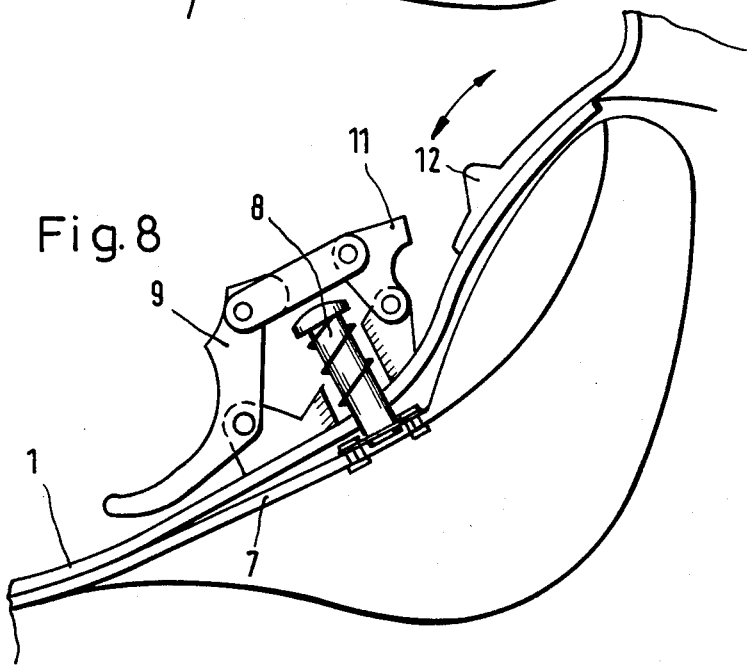
FIG. 8 is a corresponding fragmentary side elevation of the boot of FIG. 7 with parts in different positions.

In the embodiment shown in FIGS. 7 and 8, the locking lever 9 is pivotally connected to the lower boot part 1 for swinging about an axis spaced a substantial distance forward of the bolt 8. Such locking lever has a rearward-projecting portion extending over the head of the bolt 8 and a forward-projecting portion forming a handle. Upward swinging of the handle engages the rear end portion of the locking lever against the head of the bolt and forces it inward, whereas downward swinging of the handle moves the rear end portion of the locking lever generally upward to allow outward movement of the bolt and the instep plate. The latch member 11 connected to the locking lever is pivotally connected to the lower boot part for swinging about an axis spaced rearward from the bolt 8 and has a rearward-projecting hook engageable over a projection of the upper boot part forming the catch 12. A generally horizontal link has its opposite end portions connected, respectively, to the rear end portion of the locking lever 9 and the front end portion of the latch member 11. Such link extends over the head of the bolt 8. Consequently, with the upper boot part swung forward to its vorlage position, upward swinging movement of the forward-projecting handle of the locking lever 9 not only forces the bolt 8 and instep plate 7 inward, but also swings the latch member rearward to lock the upper boot part in the vorlage position. With the upper boot part released as shown in FIG. 8, the compression spring encircling the bolt 8 prevents unintentional locking movement of the locking lever 9 during walking.

Figure 9:
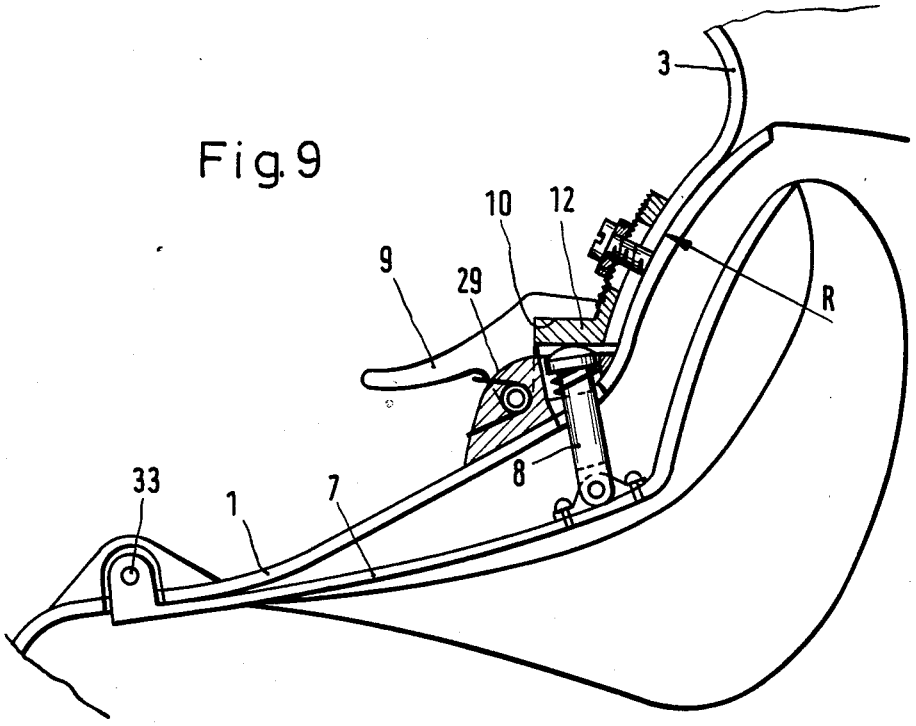
FIG. 9 is an enlarged, fragmentary, side elevation of another ski boot in accordance with the present invention with parts shown in section, illustrating another modified form of locking mechanism.
Figure 10:
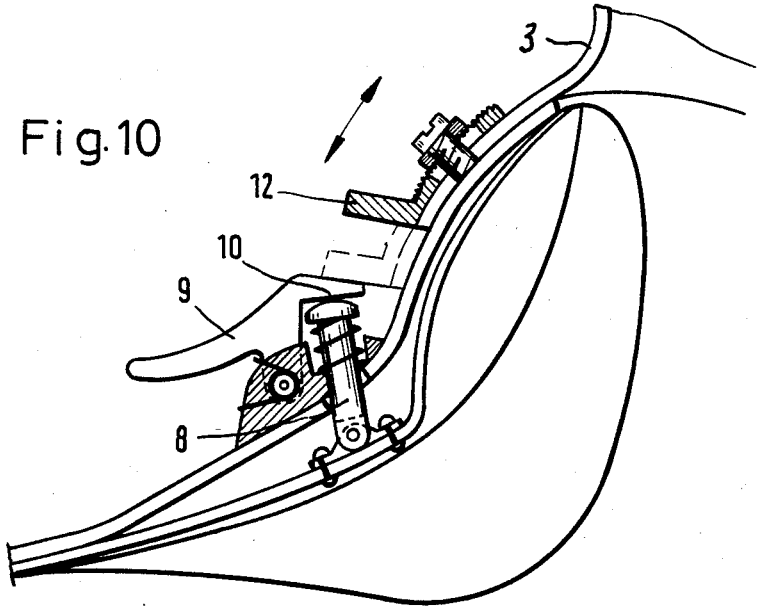
FIG. 10 is a corresponding fragmentary side elevation of the boot of FIG. 9 with parts in different positions.

In the embodiment shown in FIGS. 9 and 10, again the locking lever 9 is mounted on the lower boot part 1 for swinging about an axis spaced forward from the bolt 8 and has a forward-projecting handle portion and a rearward-projecting portion forming the latch member and extending over the head of the bolt. The upper boot part 3 carries the forward-projecting catch 12 which, in the locking position shown in FIG. 9, is engaged against the head of bolt 8 and holds it in its inward-projected position. In such position, the bottom pressure surface 10 of the locking lever is engaged over the top of the catch 12 and is biased to such position by a spring 29 to lock the upper boot part 3 in the vorlage position. The forward-projecting handle portion of the locking lever 9 can be manually pushed downward to release the forward projecting catch 12 and allow rearward swinging of the upper boot part 3 and outward movement of the bolt 8 and instep plate 7.When the handle is released, the locking lever is rotated clockwise as shown in the drawings to the position shown in FIG. 10 by the force of the spring 29 which prevents unintentional locking of the upper boot part in the vorlage position during walking.

Figure 18:
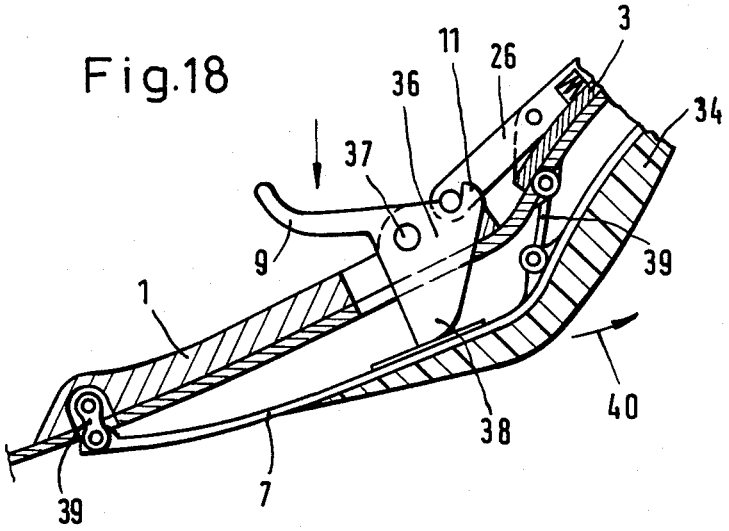
FIG. 18 is an enlarged, fragmentary, side elevation of another ski boot in accordance with the present invention, with parts shown in section, illustrating another modified form of locking mechanism.

In the embodiment shown in FIG. 18, the locking lever 9 is in the form of an eccentric cam carried by the bottom boot part and swingable about a horizontal axis 37 above a slot through which the bottom projecting cam or pressure portion 38 of the locking lever projects. Such bottom portion of the locking lever is engaged against the upper surface of the movable instep plate 7. The rear end portion of the locking lever forms the latch member 11 having an upward opening groove for receiving a pin carried by a catch lever 26 swingably mounted on the upper boot part 3 and biased to the position shown in FIG. 18 by a compression spring. In such position, the pressure portion 38 of the locking lever holds the instep plate 7 in its inward-projecting position, but manual rotation of the locking lever clockwise as shown in FIG. 18 releases the instep plate and also frees the pin of the catch lever 26 from the groove of the latch member 11 allowing rearward movement of the upper boot part 3. In addition, rather than simple downward swinging movement of the instep plate about a fixed axis as in the previously described embodiment, the instep plate of the embodiment shown in FIG. 18 is carried by links for swinging downward and rearward in the general direction indicated by the arrow 40 as the locking lever is rotated to its locking position.

Figure 19:
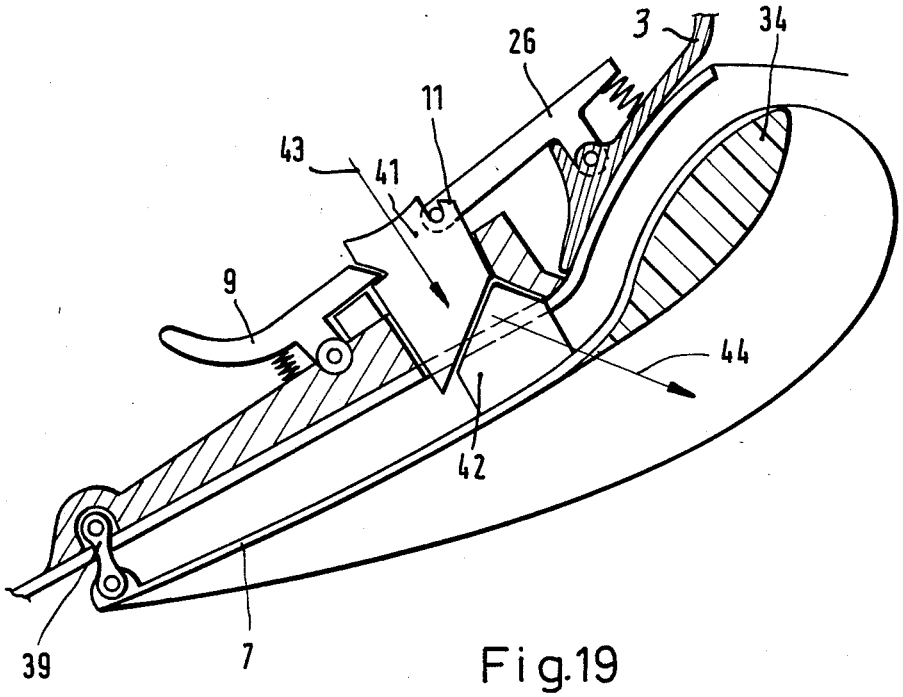
FIG. 19 is an enlarged, fragmentary, side elevation of another ski boot in accordance with the present invention, with parts shown in section, illustrating another modified form of locking mechanism.

In the embodiment shown in FIG. 19, again a link 39 is pivotally connected between the lower boot part 1 and the forward end portion of the instep plate 7 to mount the instep plate inside the boot. The instep plate carries an upward-projecting block 42 having an upward and rearward inclined top surface engageable against the similarly inclined bottom surface of a wedge member 41. Wedge member 41 is in the lower boot part so as to be slidable in the direction indicated by the arrow 43. Inward sliding movement of the wedge 41 in the direction indicated by the arrow 43 moves the instep plate 7 in the general direction indicated by the arrow 44, namely, downward and rearward. The wedge member 41 has a forward opening notch for receiving the rear tip portion of the locking lever 9 pivotally mounted on the lower boot part. Such rear tip portion of the locking lever is biased downward by a spring. The rear portion of the wedge member 41 forms the catch member 11 having an upward-opening groove for receiving a pin carried by a swingable catch lever 26 pivotally mounted on the upper boot part 3. From the vorlage position shown in FIG. 19, the catch lever 26 can be swung clockwise against the force of its spring to free the catch pin from the groove of the latch member 11 and allow rearward swinging of the upper boot part for walking. The inward pressure applied by the instep plate 7 can be relieved by swinging the locking lever 9 counterclockwise against the force of its spring which allows the wedge member 41 to move outward.

Figure 20:
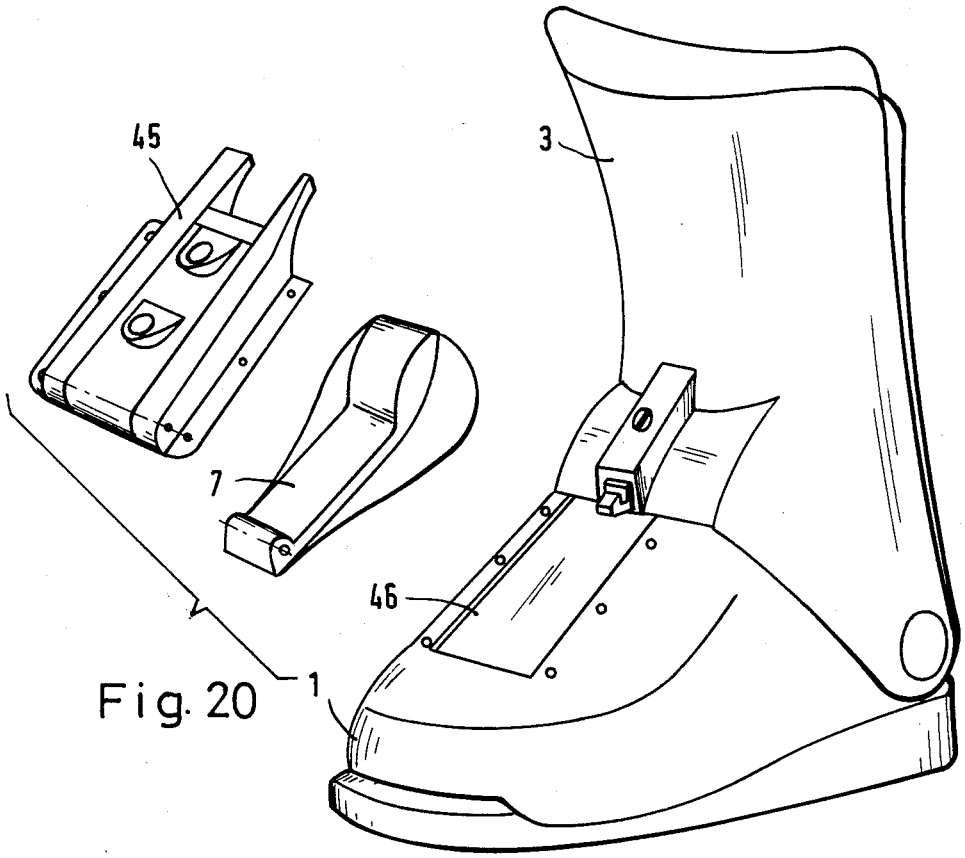
FIG. 20 is a somewhat diagrammatic top perspective of another ski boot in accordance with the present invention, with some parts shown in exploded relationship.
Figure 21:
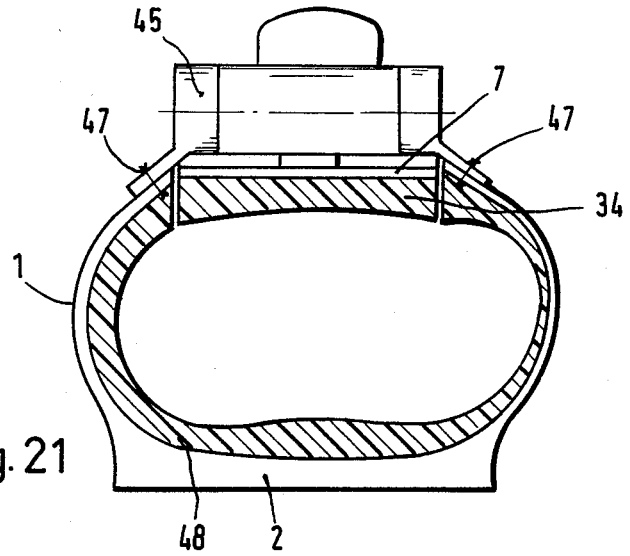
FIG. 21 is a transverse vertical section of the ski boot shown in FIG. 20 but with the parts assembled.

In the embodiment shown in FIGS. 20 and 21, the instep plate 7 is fitted in a slot 46 through the top of the lower boot part 1. The mounting 45 for the locking lever is secured to the lower boot part by screws 47 as shown in FIG. 21. The forward end of the locking lever and the forward end of the instep plate are pivotally mounted to the forward end portion of the mounting 45. The inward swung position of the instep plate 7 is shown in FIG. 21 where the locking lever is swung downward into engagement with the top of the instep plate to hold it inward. In addition, such downward movement of the locking lever engages its rear end portion in a catch carried by the upper boot part to hold such upper boot part in the vorlage position. Upward swinging movement of the rear end portion of the locking lever frees the upper boot part for walking and also allows upward swinging movement of the rear end portion of the instep plate.

Figure 17:
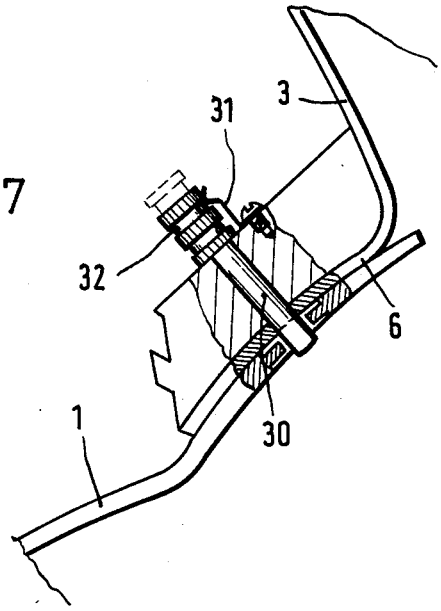
FIG. 17 is an enlarged, fragmentary, side elevation of another ski boot in accordance with the present invention, with parts shown in section, illustrating another modified form of locking mechanism.

In the modifications shown in FIG. 17, a pin 30 is slideably mounted in the lower end portion of the upper boot part 3 in its area 6 overlapping the upper end portion of the lower boot part 1. Such upper end portion of the lower boot part has a hole or slot which, when the upper boot part is in the vorlage position, is in registration with the pin 30 so that inward movement of the pin 30 to the position shown in FIG. 17 locks the upper boot part in the vorlage position. The outer end portion of the pin 30 is enlarged and has a groove 32 into which a leaf spring 31 fits with the pin in its inward-projecting or locking position. The upper boot part can be released from the vorlage position by manually pulling the pin 30 outward. The mechanism shown in FIG. 17 can be provided in any of the previously described embodiments to provide a second mechanism for locking the upper boot part in the vorlage position.

We claim:

1. In a ski boot having a lower foot-enclosing portion, an upper leg-enclosing portion, such upper portion being swingable relative to such lower portion between a vorlage position and a rearward-swung, more upright position, and instep plate means carried inside the boot for engaging generally over the top of the user's foot and movable generally toward and away from the user's foot between inward and outward moved positions, the improvement comprising locking means including interengageable latch components carried, respectively, by the upper and lower boot portions for locking the upper portion in its vorlage position but disengageable so as to release the upper portion for rearward swinging movement relative to the lower portion, said locking means including means for automatically locking the instep plate in its inward moved position when said latch components are engaged.

2. In the ski foot defined in claim 1, the locking means including means for automatically freeing the instep plate for movement from its inward moved position to its outward moved position when the latch components are disengaged.

3. In the ski boot defined in claim 2, the boot lower portion having an aperture over the instep plate, and the locking means including a thrust member projecting upward from the instep plate through said aperture and a lever swingably mounted on the boot lower portion and engageable against said thrust member.

4. In the ski boot defined in claim 3, the lever being mounted on the boot lower part for swinging about an axis spaced forward of the thrust member, and the rear end portion of the lever having the latch component interengageable with the latch component carried by the upper boot portion.

5. In the ski boot defined in claim 3, the lever being an eccentric cam having an outer periphery engageable against the thrust member.

6. In the ski boot defined in claim 3, the latch component carried by the boot lower portion being movably mounted on the lever.

7. In the ski boot defined in claim 3, the lever having a bottom surface engageable against the upper end portion of the thrust member, and spring means biasing the lever away from the thrust member.

8. In the ski boot defined in claim 3, the thrust member being a bifurcated thrust bolt, the bifurcations of said bolt projecting upward from the instep plate at opposite sides of the transverse center of the boot.

9. In the ski boot defined in claim 3, means enabling adjustment of the effective length of the thrust member.

10. In the ski boot defined in claim 3, the thrust member having a shank projecting upward from the instep plate, the upper end portion of the thrust member having external threads and the thrust member including a head portion screwed onto the shank, said head portion being engageable against the lever.

11. In the ski boot defined in claim 3, the lever including an upright pin mounted above the thrust member for movement generally toward and away from the thrust member, and means for adjusting the position of said pin relative to the remainder of the lever.

12. In the ski boot defined in claim 2, the locking means including an eccentric cam swingably mounted on the lower boot portion and having a periphery engageable against the upper surface of the instep plate.

13. In the ski boot defined in claim 2, the locking means including means for adjusting the angle of inclination of the boot upper portion relative to the lower portion when the upper portion is in its vorlage position.

14. In the ski boot defined in claim 2, the boot upper and lower portions having overlapping surfaces in close sliding relationship.

15. In the ski boot defined in claim 14, the boot upper portion being pivotally mounted on the boot lower portion for swinging about a horizontal axis, and the overlapping surfaces being arcuate and substantially concentric about said axis.

16. In the ski boot defined in claim 2, means biasing the instep plate to its outward moved position.

17. In a ski boot having a lower foot-enclosing portion, an upper leg-enclosing portion, such upper portion being swingable relative to such lower portion between a vorlage position and a rearward swung, more upright position, an instep plate carried inside the boot for engaging generally over the top of the user's foot and movable generally toward and away from the user's foot between inward and outward moved positions, a catch member, means mounting the catch member on the boot upper portion, a latch member, and means mounting the latch member on the boot lower portion, such catch and latch members being interengageable for locking the boot upper portion in its voltage position, at least one of the mounting means mounting its member for movement so as to disengage such catch and latch members and permit rearward swinging movement of the boot upper portion from its vorlage position, the improvement comprising the combination of means for blocking outward movement of the instep plate from its inward moved position, and actuating means for maintaining said blocking means stationary in position blocking such outward movement of the instep plate when the upper boot portion is in its vorlage position, said actuating means including means for automatically freeing said blocking means for movement so as to permit outward movement of the instep plate by disengagement of the latch and catch members.

* * * * *

UNITED STATES PATENT AND TRADEMARK OFFICE

CERTIFICATE OF CORRECTION

PATENT NO. : 4,581,831

DATED : April 15, 1986

INVENTOR(S) : Kirsch, Bernhard

It is certified that error appears in the above-identified patent and that said Letters Patent are hereby corrected as shown below:

Column 8, line 54, cancel "foot" and insert --boot--.

Column 10, line 23, cancel "voltage" and insert --vorlage--.

The ABSTRACT OF THE DISCLOSURE should read as follows:

--The upper leg-enclosing portion of a ski boot is swingable relative to the lower foot-enclosing portion of the boot about a horizontal transverse axis in the area of the heel. An instep plate mounted inside the boot lower portion is movable toward and away from the top of the user's foot. Mechanism for locking the boot upper portion in a vorlage position includes mechanism for automatically locking the instep plate in an inward-moved position. The locking mechanism is releasable to permit relative swinging movement of the upper and lower portions

UNITED STATES PATENT AND TRADEMARK OFFICE

CERTIFICATE OF CORRECTION

PATENT NO. : 4,581,831

DATED : April 15, 1986

INVENTOR(S) : Kirsch, Bernhard

It is certified that error appears in the above-identified patent and that said Letters Patent is hereby corrected as shown below:

for comfortable walking and automatically allowing outward movement of the instep plate.--

Signed and Sealed this

*Twelfth* Day of *August 1986*

[SEAL]

*Attest:*

DONALD J. QUIGG

*Attesting Officer*

*Commissioner of Patents and Trademarks*